United States Patent [19]

Nakamura

[11] 4,110,217

[45] Aug. 29, 1978

[54] CONTINUOUS SEWAGE SLUDGE HEAT TREATMENT APPARATUS

[76] Inventor: Gichi Nakamura, 21-9, Gamo 4-chome, Jotoku, Osaka, Japan

[21] Appl. No.: 786,467

[22] Filed: Apr. 11, 1977

[51] Int. Cl.[2] ..... F26B 17/12

[52] U.S. Cl. ..... 210/175; 34/12; 34/60; 110/228

[58] Field of Search ..... 210/68, 71, 175, 183, 210/186; 110/7 B, 15; 100/73, 92, 93, 238; 34/12, 60

[56] References Cited

U.S. PATENT DOCUMENTS

| | | | |
|---|---|---|---|
| 28,810 | 3/1954 | Schmidt | 210/71 |
| 3,283,803 | 11/1966 | Phillips, Jr. et al. | 210/68 X |
| 3,348,599 | 10/1967 | Lohstorter et al. | 210/68 |
| 3,531,872 | 10/1970 | Watson et al. | 210/71 X |
| 3,592,149 | 7/1971 | Muthe | 110/15 |
| 3,736,886 | 6/1973 | Menigat | 110/15 |

FOREIGN PATENT DOCUMENTS

| | | | |
|---|---|---|---|
| 923,035 | 3/1973 | Canada | 110/238 |
| 2,243,892 | 4/1973 | Fed. Rep. of Germany | 210/68 |
| 465,523 | 6/1975 | U.S.S.R. | 110/7 B |

*Primary Examiner*—Theodore A. Granger
*Attorney, Agent, or Firm*—George B. Oujevolk

[57] ABSTRACT

A continuous sludge heat treatment apparatus in sewage disposal system having an axially porous member within a vertical vessel and radial apertures in the side wall of vessel below the axially porous member, so as to have almost all part of sludge exposed to, and thus heated directly with, steam supplied through the radial apertures while the sludge fed into the head of vessel falls down in the form of thin strings through the axial pores and hits the tail of vessel.

3 Claims, 4 Drawing Figures

CONTINUOUS SEWAGE SLUDGE HEAT TREATMENT APPARATUS

The present invention relates to a sewage disposal apparatus, and more particularly to an apparatus for continuous heat treatment of sludge delivered from the final settling tank of a sewage disposal system on a large industrial scale.

Such sludge is usually a colloidal solution of proteins and other organic matters which cannot be filtered satisfactorily as they are. Prior to filtration, therefore, such sludge may be heat-treated so as to have the colloidal contents either solidiffied or decomposed into those matters which can be filtered satisfactorily. The heat-treated solution is then passed through filter means, and the removed solid matters may be burned.

Conventionally for such heat treatment on a large industrial scale, sludge is delivered from the final settling tank of a sewage disposal system, preheated through a heat exchanger, fed into a closed vessel together with steam of a given pressure and temperature, aged for a duration of time in the vessel, and discharged out of the vessel.

During the aging the sludge is completely heated with the steam up to a given temperature which is required to solidify or decompose the colloidal contents. The required period of aging is substantially long even when sludge is treated with steam of relatively high pressure and temperature. For instance, aging of 30 to 60 minutes is required when sludge is treated with steam of 14 kg/cm$^2$ to 20 kg/cm$^2$ in terms of pressure (that is, 197° C to 216° C in terms of temperature).

The long period of aging makes it impractical to treat sludge continuously; thus the conventional apparatus is operated by batch. And the batch operation makes it necessary to provide a substantially large vessel to treat sludge practically on a large industrial scale.

On a small experimental scale it is known that thin strings of sludge can be heat-treated completely with steam of relatively low pressure and temperature without requiring a substantially long period of aging. For instance aging of 20 minutes is enough when strings of sludge as thin as about 10 mm in diameter are treated with steam of 2 kg/cm$^2$ in terms of pressure (that is, 133° C in terms of temperature) in an experimental vessel.

On a small experimental scale it is further known that thin strings of sludge can be heat-treated completely in boiling water in a substantially short while. For instance, it takes only about 10 minutes in strings of sludge as thin as about 5 mm in diameter to be heat-treated in water boiling at 100° C in an experimental vessel.

A major object of the invention is to treat sludge with steam of relatively low pressure and temperature without requiring a substantially long period of aging in sewage disposal on a large industrial scale.

Another object of the invention is to treat sludge with steam continuously in sewage disposal on a large industrial scale.

A further object of the invention is to reduce the size of vessel required to treat sludge with steam practically in sewage disposal on a large industrial scale.

Other objects and advantages of the invention will be readily appreciated as the same become better understood hereinafter when considered in connection with the accompanying drawing in which.

Figure 1:
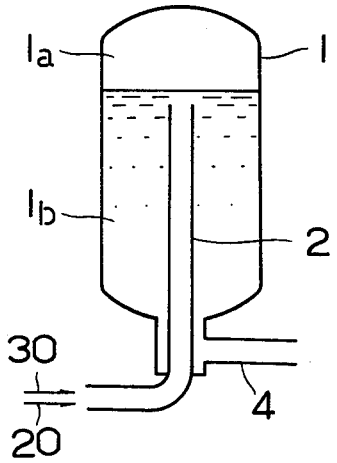
FIG. 1 is a vertical schematic elevation of a conventional apparatus for sludge heat treatment in a sewage disposal system on a large industrial scale.

Referring to FIG. 1, the conventional apparatus primarily comprises a closed vessel 1, a feed pipe 2 entering the bottom region of vessel 1 and having an upwardly open end within the top region of vessel 1, and a discharge pipe 4 leaving the bottom region of vessel 1.

Sludge is initially delivered from the final settling tank (not shown) of a sewage disposal system and then preheated to some extent through a heat exchanger (not shown). The preheated sludge is fed into the vessel 1 together with steam of a given pressure and temperature by way of the pipe 2 forcedly by the drive of pump means (not shown). The flows of steam and sludge are indicated with arrow marks 20 and 30 respectively.

During the feeding the sludge runs block by block through the feed pipe 2, each sludge block being sizable and surrounded with the steam. In this state, the outer sludge of each block is exposed to the steam surrounding it and thus heated directly with the steam immediately up to a given temperature required to solidify or decompose the colloidal contents of sludge, but the inner sludge of each block is not exposed to the steam at all. The sludge blocks get into the vessel 1 through the open end of pipe 2 long before the inner sludge of each block is heated indirectly by sludge-to-sludge heat conduction from the directly heated outer sludge in the pipe 2, because sludge has such a substantially low thermal conductivity that it takes a substantially long time for the inner sludge to be heated by sludge-to-sludge heat conduction from the outer sludge.

As the sludge blocks get into the vessel 1, a large part of the steam surrounding each sludge block leaves the sludge block and gathers in the upper part of vessel 1 as indicated with 1*a*, while the rest of the steam still remains surrounding each sludge block and settles in the lower part of vessel 1 together with the sludge block as indicated with 1*b*.

Then the sludge blocks are left to stand for aging together with the steam in the vessel 1. During the aging the outer sludge of each block is exposed to the steam surrounding it and thus heated directly with the steam, and the inner sludge of each block is not exposed to the steam but heated indirectly by sludge-to-sludge heat conduction from the directly heated outer sludge. The steam surrounding each sludge block in the vessel lower part 1*b* is always heated with the steam in the vessel upper part 1*a* both directly and by the intermediarry of vessel wall.

In a duration of time the inner sludge of each block is heated up to the temperature required to solidify or decompose the colloidal contents of sludge. Now it can be said that the sludge is completely heated up to the required temperature, in other words, the heat treatment is completed. Then the sludge is discharged out of the vessel 1 by way of the pipe 4.

As each sludge block is sizable, a large part of the sludge is in the inner part of block and a small part of the sludge is in the outer part of block. In other words, the inner sludge is much more than the outer sludge in each block. Therefore a small part of the sludge is heated by direct steam exposure in the feed pipe 2 and aging vessel 1, and a large part of the sludge is heated by sludge-to-sludge heat conduction in the aging vessel 1. Since sludge has a substantially low thermal conductivity, it is required that the period of aging is substantially long to heat a large part of the sludge up to the required temperature by sludge-to-sludge heat conduction in the vessel 1 even when the pressure and temperature of steam are relatively high.

In the small experimental case where thin strings of sludge can be heat-treated completely with steam of relatively low pressure and temperature without requiring a substantially long period of aging, thin sludge strings are charged and aged in a closed vessel together with steam of a given pressure and temperature. There the outer sludge of each string is exposed to the steam and thus heated directly with the steam immediately up to the required temperature, and the inner sludge of each string is not exposed to the steam but heated indirectly by sludge-to-sludge heat conduction from the directly heated outer sludge.

As each sludge string is thin, a small part of the sludge is in the inner part of string and a large part of the sludge is in the outer part of string, In other words, the inner sludge is much less than the outer sludge in each string. Therefore a large part of the sludge is heated by direct steam exposure in the vessel, and a small part of the sludge is heated by sludge-to-sludge heat conduction in the vessel. Though sludge has a substantially low thermal conductivity, it is not required that the period of aging is substantially long to heat a small part of the sludge up to the required temperature by sludge-to-sludge heat conduction in the vessel even when the pressure and temperature of steam are relatively low.

And almost same can be said about the small experimental case where thin strings of sludge can be heat-treated completely in boiling water in a substantially short while.

It follows that a long period of aging will be required in case a large part of the sludge is heated by sludge-to-sludge heat conduction even when it is treated with steam of relatively high pressure and temperature, and that a short period of aging will be enough in case a large part of the sludge is heated by direct steam exposure even when it is treated with steam of relatively low pressure and temperature; given the supply of steam per unit of sludge. This is the principle on which based is the present invention.

Figure 2:
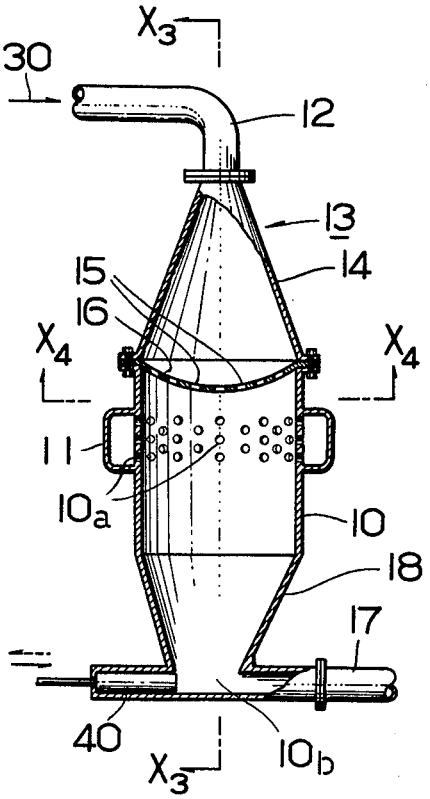
FIG. 2 is a partially-sectioned vertical elevation of a sludge heat treatment apparatus embodying the invention.
Figure 3:
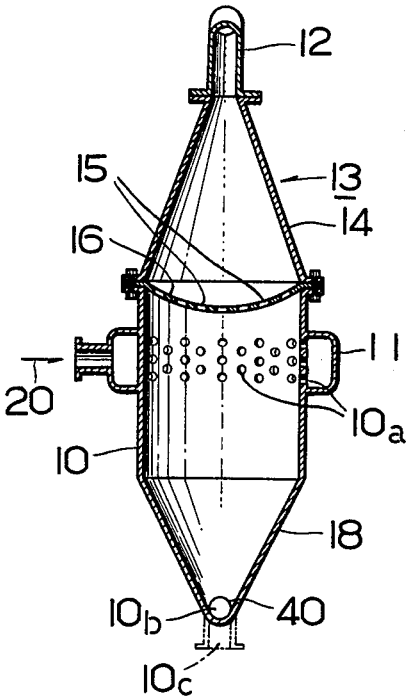
FIG. 3 is a transverse section take approximately on X3—X3 line in FIG. 2, where a discharge port is indicated in dotted lines when it is provided in place of a plunger pump.
Figure 4:
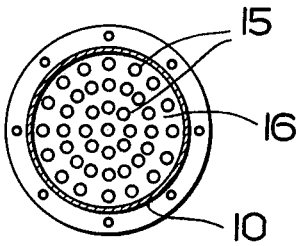
FIG. 4 is a cross section taken approximately on X4—X4 line in FIG. 2.

Referring to FIGS. 2 to 4, the embodiment primarily comprises a feed pipe 12, a discharge pipe 17, and a vertical closed vessel 13 intermediate both pipes. The vertical closed vessel 13 consists of a substantially conical head portion 14, a substantially conical tail portion 18 in an opposite relation to the head portion 14, and a substantially cylindrical middle portion 10 intermediate the head and tail portions.

The upper end of head portion 14 is connected to the feed pipe 12, and the lower end of it is provided with a round porous member 16, which is downwardly convex and provided with a plurality of axial pores 15 as best shown in FIG. 4. The side wall of middle portion 10 has a circumferential zone which is provided with a plurality of radial apertures **10*a* and surrounded with a jacket 11. The lower end of tail portion 18 is provided with a horizontal plunger pump which has a cylinder 10*b* and a piston 40. One end of the cylinder 10*b* is connected to the discharge pipe 17**.

In the operation, sludge is initially delivered from the final settling tank (not shown) of a sewage disposal system and fed into the head portion 14 of vessel 13 by way of the feed pipe 12 forcedly by the drive of pump means (not shown). Then steam of a given pressure and temperature is supplied into the middle portion 10 of vessel 13 by way of the jacket 11 and radial apertures **10*a*. And the piston 40 of plunger pump is reciprocated in the cylinder 10*b*. The flows of steam and sludge are indicated with arrow marks 20 and 30** respectively.

The sludge falls from the head portion 14 to the tail portion 18 through the porous member 16 and the middle portion 10. In this case, the sludge takes the form of thin strings as it passes the axial pores 15 of member 16. Through the middle portion 10 the thin strings of sludge are surrounded with the steam which is supplied into the middle portion 10 by way of the radial apertures **10*a*; in this state, the outer sludge of each string is exposed to the steam surrounding it and thus heated directly with the steam immediately up to a given temperature required to solidify or decomposed the colloidal contents of sludge, but the inner sludge of each string is not exposed to the steam at all. At the end of falling the sludge strings hit the tail portion 18 of vessel 13** and break utterly for the most part, thus causing the inner sludge of each string mostly to be mixed with the steam which has fallen together with the string in surrounding relation; in this state, the inner sludge of each string is mostly exposed to the steam mixing with it and thus heated directly with the steam immediately up to the required temperature.

Then the sludge is discharged out of the tail portion 18 by way of the cylinder **10*b* and the pipe 17 forcedly by the reciprocation of piston 40. The reciprocation of piston 40 causes more of the sludge to be mixed with the steam and thus heated directly with the steam up to the required temperature, as the sludge runs through the discharge pipe 17. That part of sludge which still remains unexposed to the steam is heated up to the required temperature indirectly by sludge-to-sludge heat conduction from the directly heated sludge, as the sludge runs through the discharge pipe 17. Thus the sludge is completely heated up to the required temperature, in other words, the heat treatment is completed, when the sludge leaves the discharge pipe 17**.

It can therefore be said that almost all part of the sludge is exposed to the steam and thus heated directly with the steam from when it enters the middle portion 10 of vessel 13 to when it leaves the discharge pipe 17; and a very little part of the sludge is not exposed to the steam but heated indirectly by sludge-to-sludge heat conduction through the discharge pipe 17.

Since almost all part of the sludge is heated not by sludge-to-sludge heat conduction but by direct steam exposure, the required pressure and temperature of steam can be relatively low even when the sludge is treated on a large industrial scale.

Though sludge has a substantially low thermal conductivity, a very short period of aging is enough to heat a very little part of the sludge up to the required temperature by sludge-to-sludge heat conduction in the discharge pipe 17 even when the pressure and temperature of steam are relatively low. Thus it is not necessary to let the sludge to stay to age for a particular period in the discharge pipe 17; the sludge is aged sufficiently while it is running through the pipe 17 continuously. Therefore the sludge can be treated continuously without a particular process of aging even when the sludge is treated on a large industrial scale. And this can reduce the size of vessel 13 required to treat the sludge practically.

It may be good to provide the tail portion 18 of vessel 13 with a discharge port 10*c* in place of the cylinder 10*b* and piston 40, as particularly indicated in dotted lines in FIG. 3.

It will be understood that further modifications may be made in the construction of the above shown embodiment, and that the invention is in no way limited to the shown embodiment.

What is claimed is:

1. In an apparatus for the heat treatment of a sludge mass delivered from a final settling tank of a sewage disposal system having a feed pipe (12), a discharge pipe (17), a vertical cylindrical vessel (19) with a side wall (10), a substantially vertical conical head portion (14) connected to the upper edge of said vertical cylindrical vessel, said head portion having an upper end connected to said feed pipe (12), the improvement in said apparatus to continuously treat the sludge with steam of relatively low pressure and temperature by converting the sludge mass into thin strings of sludge, and steam treating these strings, said improvement comprising: a lower end to said head portion (14) and a round member thereat with a plurality of axial pores (15) through which the sludge mass must pass and be converted into individual vertical strings of sludge axially disposed in said vertical cylindrical vessel (19), a steam feeding jacket (11) surrounding said side wall (10) with a plurality of radial apertures in said side wall to allow steam from said jacket to enter into said cylindrical vessel (19) and heat the vertical sludge strings therein; a conical tail portion connected to the lower end of said cylindrical vessel with its lower end in substantial opposite relationship to said head portion to receive the treated sludge-steam mixture, said lower end being coupled to said discharge pipe (17) and means to facilitate discharge of said treated sludge.

2. An apparatus for heat treatment of sludge in accordance with claim 1, wherein said means to facilitate discharge of sludge comprise a horizontal plunger pump means having a cylinder and a piston, one end of said cylinder being connected to said discharge pipe.

3. An apparatus for heat treatment of sludge in accordance with claim 1, wherein said means to facilitate discharge of sludge comprises port means connected to said discharge pipe.

* * * * *